US012320366B2

(12) United States Patent
Quercia et al.

(10) Patent No.: US 12,320,366 B2
(45) Date of Patent: Jun. 3, 2025

(54) CENTRIFUGAL COMPRESSOR AND METHOD OF OPERATING THE CENTRIFUGAL COMPRESSOR TO PRODUCE A UNIFORM INLET FLOW OF PROCESS GAS

(71) Applicant: NUOVO PIGNONE TECNOLOGIE SRL, Florence (IT)

(72) Inventors: Marco Quercia, Florence (IT); Giuseppe Sassanelli, Florence (IT); Simone Corbo, Florence (IT); Angelo Grimaldi, Florence (IT)

(73) Assignee: Nuovo Pignone Tecnologie—S.R.L., Florence (IT)

( * ) Notice: Subject to any disclaimer, the term of this patent is extended or adjusted under 35 U.S.C. 154(b) by 43 days.

(21) Appl. No.: 17/997,882

(22) PCT Filed: Apr. 29, 2021

(86) PCT No.: PCT/EP2021/025164
§ 371 (c)(1),
(2) Date: Nov. 3, 2022

(87) PCT Pub. No.: WO2021/223912
PCT Pub. Date: Nov. 11, 2021

(65) Prior Publication Data

US 2023/0175526 A1 Jun. 8, 2023

(30) Foreign Application Priority Data

May 8, 2020 (IT) ..... 102020000010297

(51) Int. Cl.
*F04D 29/44* (2006.01)
*F04D 17/10* (2006.01)
*F04D 29/42* (2006.01)

(52) U.S. Cl.
CPC ..... *F04D 29/441* (2013.01); *F04D 17/10* (2013.01); *F04D 29/4206* (2013.01)

(58) Field of Classification Search
CPC ..... F04D 29/441; F04D 17/10; F04D 29/4206
See application file for complete search history.

(56) References Cited

U.S. PATENT DOCUMENTS 3,421,446 A 1/1969 Strscheletzly et al.
3,472,029 A 10/1969 Colley
(Continued)

FOREIGN PATENT DOCUMENTS

EP 2975270 A1 1/2016
JP 11351198 A 12/1999
(Continued)

*Primary Examiner* — Courtney D Heinle
*Assistant Examiner* — Andrew Thanh Bui
(74) *Attorney, Agent, or Firm* — Paul Frank + Collins P.C.

(57) ABSTRACT

The centrifugal compressor has a housing with two or more compressor inlets for process gas to be compressed; an impeller is located inside the housing so to receive an inlet flow of process gas from the two compressor inlets through a plenum chamber and increases gas pressure as process gas flows in the impeller; thanks to the two or more inlets, uniformity of flow at the inlets may be achieved through short collector pipes fluidly connected upstream of the inlets; piping of a compressor system including such compressor is made easy as it is subject to fewer constraints.

18 Claims, 5 Drawing Sheets

(56) References Cited

U.S. PATENT DOCUMENTS

| | | | | |
|---|---|---|---|---|
| 4,255,082 | A | 3/1981 | Goebel | |
| 6,651,431 | B1 * | 11/2003 | Yang | F04D 29/4206 60/605.1 |
| 10,458,430 | B2 * | 10/2019 | Nakaniwa | F04D 29/4213 |
| 2015/0377251 | A1 | 12/2015 | Sezal et al. | |
| 2016/0131153 | A1 | 5/2016 | Koivikko et al. | |
| 2016/0138501 | A1 | 5/2016 | Keating | |
| 2017/0370377 | A1 * | 12/2017 | Nakaniwa | F04D 29/444 |
| 2020/0132079 | A1 * | 4/2020 | Vlastuin | F04D 17/122 |

FOREIGN PATENT DOCUMENTS

| | | | |
|---|---|---|---|
| JP | 2011021503 | A | 2/2011 |
| RU | 2677308 | C2 | 1/2019 |
| RU | 2700212 | C2 | 9/2019 |

* cited by examiner

CENTRIFUGAL COMPRESSOR AND METHOD OF OPERATING THE CENTRIFUGAL COMPRESSOR TO PRODUCE A UNIFORM INLET FLOW OF PROCESS GAS

TECHNICAL FIELD

The subject-matter disclosed herein relates to centrifugal compressors, compressor systems and methods for operating centrifugal compressors.

BACKGROUND ART

Known centrifugal compressors have a casing with a single inlet, and an impeller inside the casing and downstream of the inlet. The inlet receives an inlet flow of process gas to be compressed by the impeller from a single suction duct that is fluidly connected to the inlet upstream thereof.

The design of known centrifugal compressors is made under the assumption that the inlet flow of process gas is uniform. Excessive non-uniformity in the inlet flow may cause malfunctioning of the impeller of the compressor, compromising its performance or even potentially causing surges and structural damage to the compressor.

In order to avoid such problems, it is recommended by compressor manufacturer that a portion of a suction duct directly upstream of the compressor inlet is rectilinear at least for a predetermined length so to reduce or eliminate non-uniformity in the inlet flow. Therefore, such rule should be followed when designing plants, specifically their piping, including one or more compressors.

The above-mentioned length increases with the cross-section area of the compressor inlet, which in turn depends on the size of the compressor and the flow rate to be processed by the compressor. Therefore, while it is relatively easily to adhere to such application rule for small compressors, long suction ducts would presently be required for large compressors.

Large compressors are attractive as they have high efficiency and the ability to process large volumetric flows. However, in the case of large compressors, rectilinear suction ducts might reach a length in the order of tens of meters which imposes serious constraints in the design of plants piping. Such problem is even worse for preassembled plant modules including compressors, especially modules designed to be transported for example on ships after being assembled as the sizes of the modules increase.

SUMMARY

According to a first aspect, the subject-matter disclosed herein relates to a centrifugal compressor including a housing and an impeller located inside the housing; the housing has two or more inlets for receiving an inlet flow of process gas to be compressed by the compressor. Suction ducts directly upstream of the inlets are used for reducing or removing flow non-uniformities. Their lengths may be chosen based on the cross-section areas of each inlet and not according to the total cross-section area of all inlets. Therefore, suction ducts may be short thanks to the number of the inlets.

According to a second aspect, the subject-matter disclosed herein relates to a compressor system including at least one centrifugal compressor having two or more inlets for receiving an inlet flow of process gas. As suction ducts directly upstream of the inlets are preferably straight but may be short, system piping is made easy as it is subject to fewer constraints.

According to a third aspect, the subject-matter disclosed herein relates to a method of operating a centrifugal compressor. A flow of process gas to be compressed is generated and then it is split into a first process gas flow and a second process gas flow; each of the process gas flows is advanced along a preferably rectilinear path in order to reduce or remove flow non-uniformities, and then the two process gas flows are appropriately merged before being fed to an impeller of the compressor. Preferably, merging is performed so that the gas flow received by the impeller is optimized.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS

Figure 1:
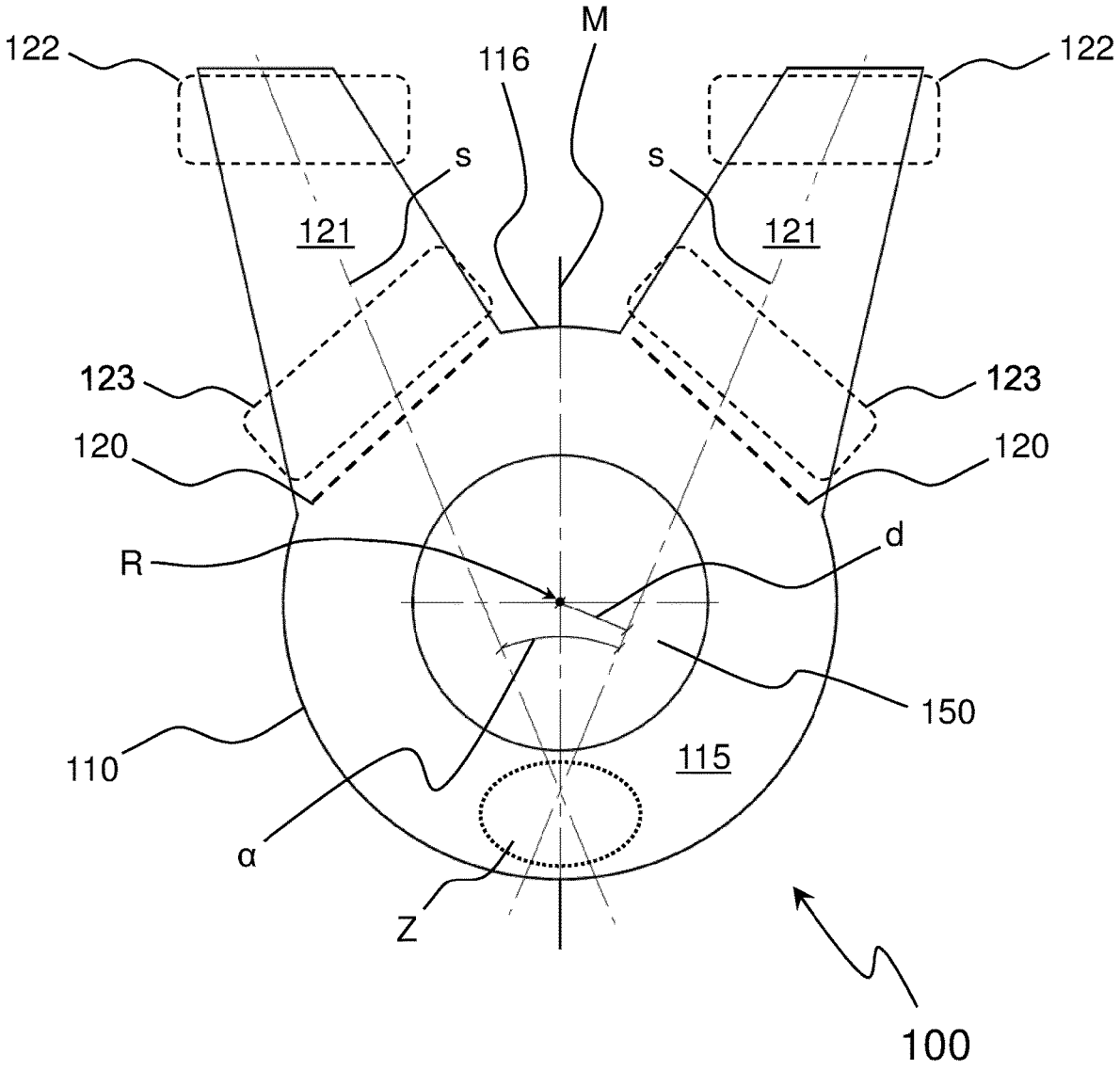
FIG. 1 shows a simplified transversal cross-sectional view of an embodiment of a centrifugal compressor according to the subject matter disclosed herein.

The centrifugal compressor disclosed herein includes a housing and an impeller located inside the housing. The housing has two or more inlets for receiving a flow of process gas to be compressed by the compressor. Suction ducts are coupled upstream of the inlets of the compressor for reducing or removing flow non-uniformities in the gas flows fed to the inlets; the suction ducts may take the form of straight (typically identical) pipes. In this way, the quantity of process gas that can be compressed by the compressed depends on the total cross-section area of all these pipes. However, the length of each of these pipes depends on the cross-section area of a single pipe and not the total cross-section area of all of them. Therefore, they may be short and not bulky as a whole.

Reference now will be made in detail to embodiments of the disclosure, an example of which is illustrated in the drawings. The example is provided by way of explanation of the disclosure, not limitation thereof. In fact, it will be apparent to those skilled in the art that various modifications and variations can be made in the present disclosure without departing from the scope or spirit of the disclosure.

Figures from 1 to 4 show an embodiment of a centrifugal compressor 100, to be arranged for example along a gas pipeline or in gas treating plant.

Centrifugal compressor 100 is arranged to compressor a process gas flow. The features disclosed herein are particularly advantageous when embodied in large centrifugal compressors having for example a gas flow rate comprised between about 200,000 $m^3/h$ and about 600,000 $m^3/h$.

Centrifugal compressor 100 has a housing 110. The housing 110 defines a plenum chamber 115 and has at has two inlets 120 configured for conveying inlet process gas flows into plenum chamber 115, as clearly shown for example in FIG. 1 and FIG. 2. According to alternative embodiments, the number of inlets may be higher, for example three or four, i.e. at least one inlet additionally to the mentioned two inlets; however, having only two inlets provides good results and turns to be a good compromise. In a large centrifugal compressor, each of these two inlets may have a cross-section area comprised between about 0.75 $m^2$ and about 3.3 $m^2$; preferably, the cross-section area of each inlet is smaller than 1.7 $m^2$ for a compressor of 300000 $m^3/h$ and smaller than 2.8 $m^2$ for a compressor of 500000 $m^3/h$.

According to the embodiment of the figures, plenum chamber 115 has a substantially cylindrical shape; plenum chamber 115 may house a portion of a shaft 160 of the compressor; plenum chamber 115 may also house a guide member 150. Plenum chamber 115 is defined radially by an outer wall 116 and an inner wall 117 which faces the outer wall 116. According to the specific embodiment of the figures, inner wall 117 corresponds to a portion of the external surface of guide member 150; therefore, if shaft 160 and guide member 150 are considered, a front portion of plenum chamber 115 (on the left in FIG. 2) is substantially annular shape, a rear portion of plenum chamber 115 (on the right in FIG. 2) is also substantially annular shape. Preferably, plenum chamber 115 has a circular axis of symmetry.

Inlets 120 are preferably located on outer wall 116 of plenum chamber 115, that is preferably cylindrical or frustoconical shape. Plenum chamber may be considered to be made of two equal or similar halves: a proximal wherein inlets are located and a distal half wherein inlets are not located.

Figure 2:
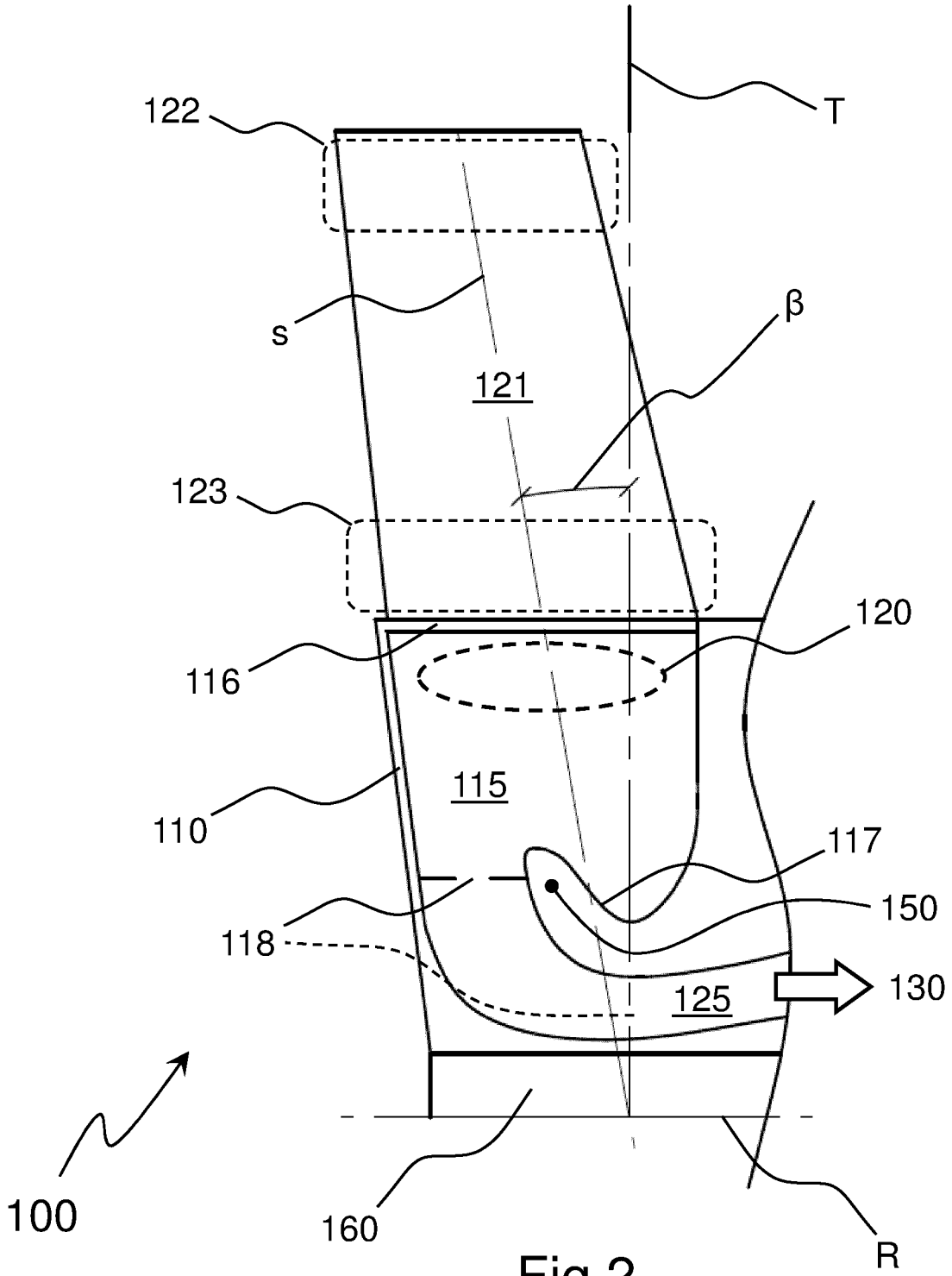
FIG. 2 shows a simplified meridional cross-sectional partial view of the compressor of FIG. 1.

Plenum chamber 115 has an outlet; considering FIG. 2, outlet 118 is adjacent to inner wall 117 and faces the outer wall 116 and inlets 120; in particular, it is an annular outlet and contributes in radially defining a front portion of plenum chamber 115. The inlet process gas flows inside plenum chamber 115 from inlets 120 to outlet 118 and has a radial component of the velocity directed towards the circular axis of symmetry of plenum chamber 115.

Housing 110 houses an impeller 130 arranged downstream of plenum chamber 115, in fluid connection with plenum chamber 115. Impeller 130 is rotatable around a rotation axis "R", which extends along a longitudinal direction of centrifugal compressor 100 and preferably coincides with the circular axis of symmetry of plenum chamber 115. Housing 110 further has an outlet located downstream of impeller 130 which is not illustrated in the annexed figures.

A channel 125 is arranged between outlet 118 and impeller 130 in order to convey process gas from plenum chamber 115 to impeller 130. In particular, guide member 150 partially defines channel 125 from the plenum chamber 115 and separates channel 125 from the rear portion of plenum chamber 115. Outlet 118 is located between plenum chamber 115 and channel 125 at a narrowing or bottleneck along the flow path of the process gas.

It is to be noted that differently from what described above, plenum chamber may have a flat annular outlet instead of a cylindrical annular outlet (see dashed line associated to reference 118 in FIG. 2), and channel may develop only substantially axially instead of developing initially substantially radially and finally substantially axially.

Impeller 130 is configured to exert, through its rotation, a suction on the gas in plenum chamber 115 and determine a gas flow from inlets 120, through plenum chamber 115 and toward compressor outlet, while centrifugally increasing its pressure between the compressor inlets and the compressor outlet.

According to the working configuration of centrifugal compressor 100, the plenum chamber 115 is located downstream of inlets 120 and upstream of impeller 130 and is configured to evenly distribute the pressure and velocity in the inlet process gas flow toward impeller 130.

According to the embodiment of the figures, inlets 120 have equal cross-sections (or substantially equal cross-sections); furthermore, inlets 120 are symmetrically arranged with respect to a meridional plane "M" of the compressor, i.e. plane containing rotation axis "R". Such symmetry contributes to evenly distribute the pressure and velocity in the inlet process gas flow toward impeller 130.

Preferably, centrifugal compressor 100 includes two collectors 121 connected to housing 110 which are in fluid communication with plenum chamber 115 through inlets 120. In particular, each collector 121 protrudes in a straight direction from housing 110 and has a collector inlet 122 connectable to an upstream suction gas duct and a collector outlet 123 connected to an inlet 120. Collectors 121 are arranged to convey respective process gas flows from two upstream suction ducts to plenum chamber 115 and are configured to reduce or eliminate non-uniformity in the flow of process gas from collector inlet 122 to collector outlet 123. In this way, the system piping is subject to lower constraints as inlet process gas flow may be guided in a desired manner.

Advantageously, collectors 121 are symmetrically arranged with respect to a meridional plane "M" of centrifugal compressor 100. A meridional plane is a plane containing rotation axis "R". In particular, the meridional plane "M" is arranged vertically with respect to the working configuration of centrifugal compressor 100. Such symmetry contributes to evenly distribute the pressure and velocity in the inlet process gas flow toward impeller 130.

Furthermore, each collector 121 has preferably a distance between collector inlet 122 and collector outlet 123 comprised between about 1 and about 3 times a diameter of collector inlet 122, more preferably between 1.3 and 2.5. In this way, the system piping is subject to lower constraints as inlet process gas flow is sufficiently well guided toward plenum chamber 115 independently from the external system piping.

Advantageously, each collector 121 defines a divergent duct which diverges from collector inlet 122 to collector outlet 123, so to cause a deceleration of the gas flowing through it. Preferably, the area ratio between the cross-section area of collector outlet 123 and the cross-section area of collector inlet 122 is comprised between about 1.0 and about 1.3, in order to achieve a desired deceleration of the gas and thus reduce turbulence and improve uniformity in the gas flowing towards impeller 130. However, it is not to be excluded using a duct converging from collector inlet 122 to collector outlet 123 wherein the area ratio between the cross-section area of collector outlet 123 and the cross-section area of collector inlet 122 is comprised between about 0.75 and about 1.0.

Preferably, each collector 121 has and end portion adjacent to its outlet 123 extending longitudinally along a respective straight line "s"; the length of this portion may be for example at least 400 mm long; elsewhere, collectors 121 may extend along a more or less curved line. Alternatively, collectors 121 may be completely straight, as shown for example in FIG. 1 and FIG. 2, so to reduce or avoid generation of turbulence in the gas flow toward plenum chamber 115.

According to preferred embodiments, the above-mentioned straight lines "s" of collectors 121 do not intercept rotation axis "R" of impeller 130, as shown in FIG. 1. In particular, each straight line "s" has a minimum distance "d" from rotation axis "R" for greater than 0 mm and smaller than about 1000 mm, preferably smaller than about 0.3 times the diameter of outer wall 116; this means that gas flows from collectors 121 are preferably directed not to a central zone of plenum chamber 115 but to a peripheral zone "Z" (i.e. a lower zone in FIG. 1) where there is advantageously a septum as explained in the following. However, it is not to be excluded that straight lines "s" intercept rotation axis "R".

Preferably, straight lines "s" of collectors 121 intersect each other and form an angle $\alpha$ in the range from about 15° to about 30° (see FIG. 1). In other words, collectors 121 are preferably arranged so that the intersection point of straight lines "s" is positioned in plenum chamber 115 on the opposite side of collectors 121 (and inlets 120) with respect to rotation axis "R", as shown in FIG. 1 inside zone "Z".

It is to be noted that straight lines "s" of collectors 121 intersect at a point of a zone, but gas flows from collectors do not necessarily merge (and mix) at that zone. As it will be apparent from the following, preferably do not substantially merge (and mix) at that zone but subsequently. Therefore, the above mentioned direction and angles are aimed at delaying merging (and mixing) of the gas flows from the inlets and collectors.

Preferably, the collector inlets 122 have equal cross-section and a cross-section area. In particular, the cross-section area may be comprised between about 0.75 $m^2$ and about 2.5 $m^2$ depending on the desired flow rate. Furthermore, preferably collector outlets 123 have preferably equal cross-section, matching the cross-section of inlets 120 described.

Advantageously, straight lines "s" form an angle $\beta$ with a plane "T" transversal to rotation axis "R" of centrifugal compressor 100 (see FIG. 2); angle $\beta$ is preferably in the range from about 10° and to about 20°. In this way, axial flow of the gas entering plenum chamber 115 through inlets 120 toward impeller 130 is promoted and generation of turbulence inside plenum chamber 115 is reduced while the compressor inlets are substantially radial as well as the orientation of any collector.

Preferably, centrifugal compressor 100 comprises one or more septa arranged in plenum chamber 115 in order to avoid flow interference between gas flows from inlets 120 due to their "collision" and their contemporaneous counter rotation inside plenum chamber 115 which may cause generation of turbulence inside plenum chamber 115 and in the gas flowing toward impeller 130; in other words a gradual merging (and mixing) between the gas flows from the inlets is desired and achieved thanks to the one or more septa. In particular, centrifugal compressor 100 includes two septa 140*a* and 140*b* (see for example FIG. 3), that may be collectively referred to as 140, locate in the plenum chamber 115 at two opposite sides with respect to its axis of circular symmetry that corresponds (or substantially corresponds) to rotation axis "R". In particular, the two septa 140*a* and 140*b* are arranged to divide plenum chamber 115 into two symmetrical and substantially separated volumes.

According to the embodiment of the figures, there are a proximal septum 140*a* and a distal septum 140*b*. Proximal septum 140*a* is located in the proximal half of plenum chamber 115 (upper half of plenum chamber 115 in FIG. 3), between inlets 120, preferably exactly in the middle. Distal septum 140*b* is located in the distal half of plenum chamber 115 (lower half of plenum chamber 115 in FIG. 3), preferably in an opposite position to the proximal septum 140*a* with respect to its axis of circular symmetry that corresponds (or substantially corresponds) to rotation axis "R".

Preferably, septa 140 have a substantially planar geometry and are arranged in plenum chamber 115 on a meridional plane of centrifugal compressor 100. In particular, on vertical meridional plane "M" according to a working configuration of the centrifugal compressor 100.

Figure 3:
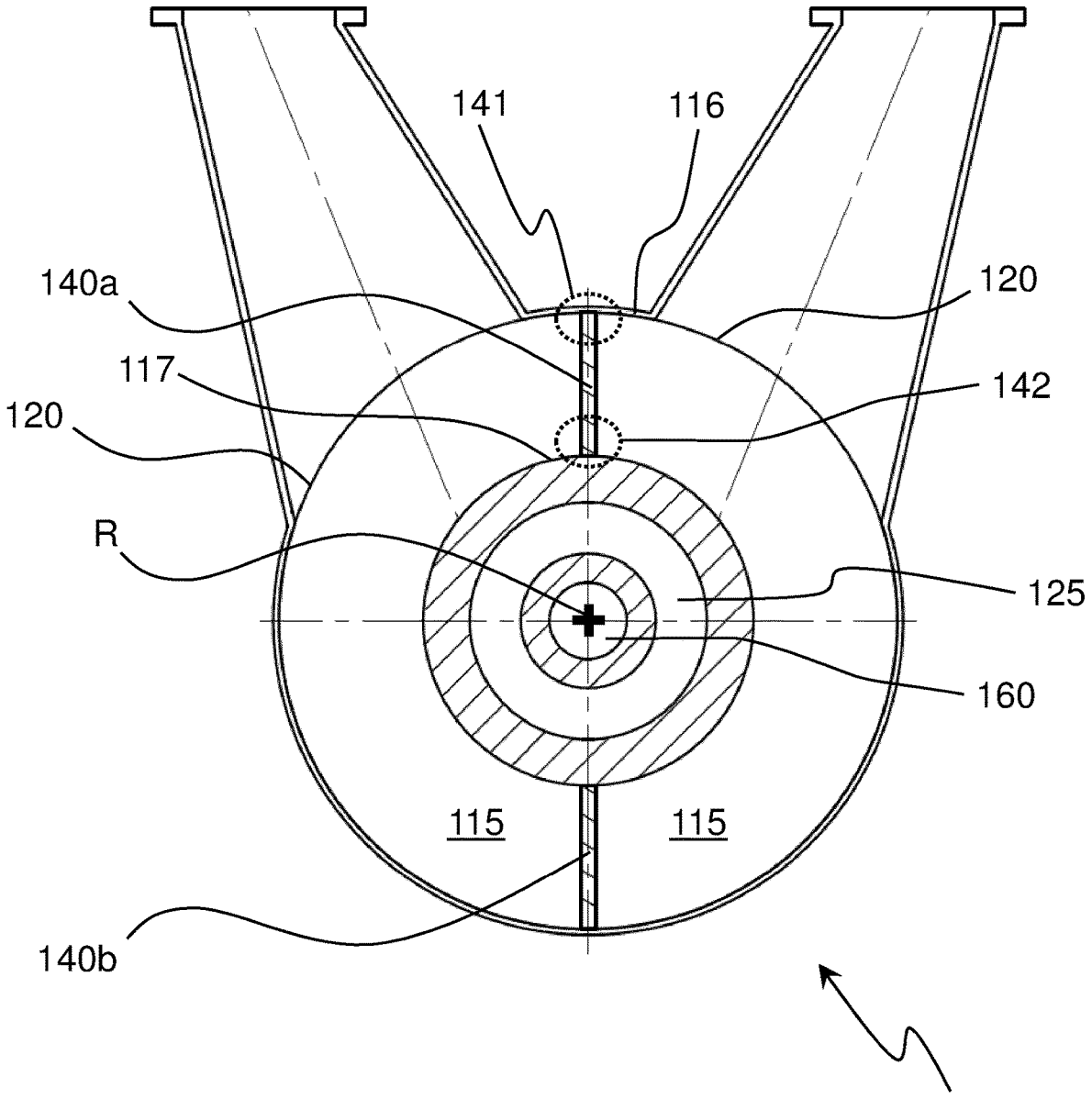
FIG. 3 shows a more detailed transversal cross-sectional view of the compressor of FIG. 1.
Figure 4:
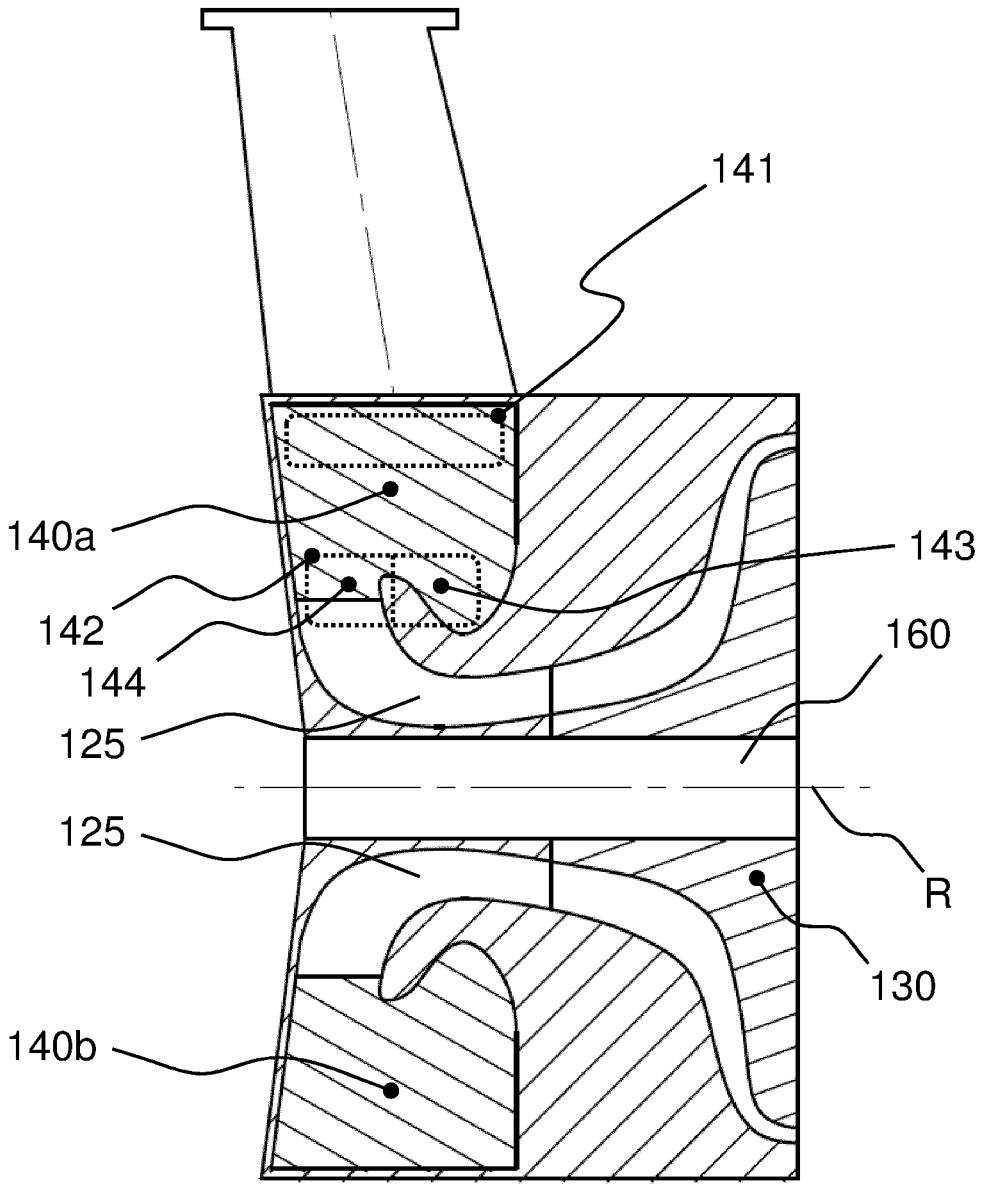
FIG. 4 shows a more detailed meridional cross-sectional partial view of the compressor of FIG. 1.
Figure 5:
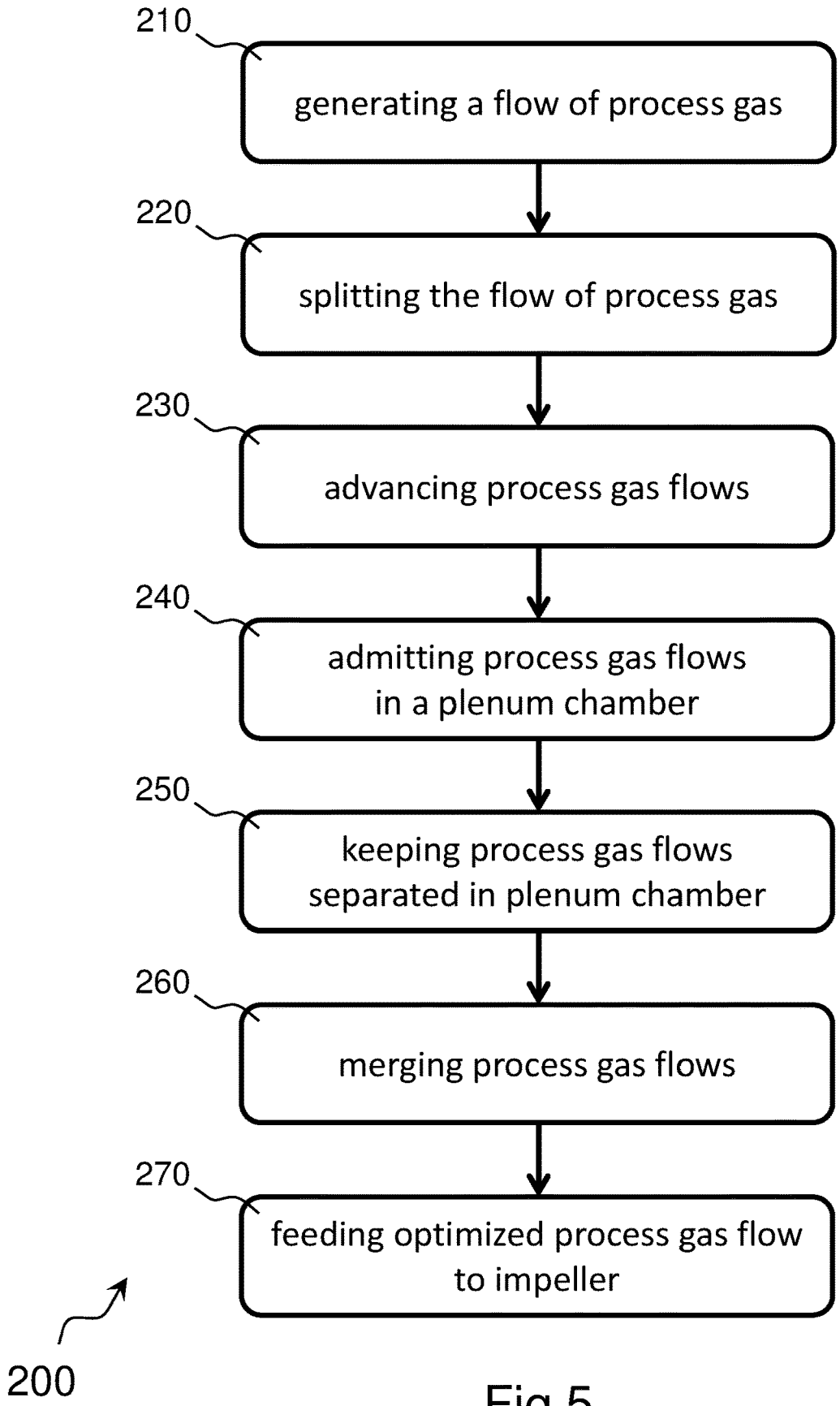
FIG. 5 shows a flow chart of an embodiment of a method according to the subject matter disclosed herein.

According to the embodiment of the figures, each septum 140 extends from a first end 141 located at outer wall 116 to a second end 142 located, at least in part, at inner wall 117 and entirely occupies a meridional cross-section of plenum chamber 115 (in particular a meridional cross-section of rear portion of plenum chamber 115), as shown in FIG. 3. In particular, second end 142 has a connecting portion 143 connected to inner wall 117 (in the rear portion of plenum chamber 115) and a free portion 144 located at outlet 118 (in the front portion of plenum chamber 115), so that the process gas in plenum chamber 115 flowing first on the opposite sides of distal septum 140*b* and then preferably on the opposite sides of proximal septum 140*a* merges (and mixes) downstream of plenum chamber 115, specifically in connecting channel 125.

According to another aspect, the subject-matter disclosed herein relates to a compressor system, not illustrated in the annexed figures.

The compressor system includes a centrifugal compressor, for example similar or identical to compressor 100 described above, and at least two suction ducts, each fluidly coupled with a respective inlet of the centrifugal compressor and arranged to convey a process gas flow to the impeller of the compressor, through the inlets and the plenum chamber.

Collectors may be integrated in the compressor. The suction ducts may be integrated in the compressor or, more commonly, may be external to the compressor and, for example, parts of a skid supporting the centrifugal compressor; these suction ducts are connected to flanges of the collectors. It is to be noted that the skid may include other piping and/or other machines.

Each of the suction ducts has preferably a straight portion directly upstream of the collectors and each straight portion extends longitudinally for example for a length comprised between about 2.5 and about 6 times the collector inlet diameter or longer. According to advantageous applications, the suction ducts are arranged substantially vertically with respect to a working configuration of the compressor system and substantially perpendicular to the rotation axis of the compressor. In particular, in order to reduce the amount of space taken up by the suction ducts, each straight portion may be limited to above mentioned range and, preferably, each of the suction ducts is entirely straight and has a length corresponding to the length of the straight portion. Additionally, the straight portions of the suction ducts are parallel to each other.

According to another aspect, the subject-matter disclosed herein relates to a method of operating centrifugal compressor, for example similar or identical to compressor 100 described above; such method may be implemented in a gas processing plant.

An embodiment of the method corresponds to the flow chart 200 in FIG. 7 including a set of consecutive steps numbered from 210 to 270.

The method includes an initial step 210 of generating a flow of process gas, for example a flow of process gas that need to be compressed by an impeller of centrifugal compressor similar or identical to impeller 130 of compressor 100.

After step 210, there is a step 220 of splitting the flow of process gas for example into a first and a second process gas flows.

After step 220, there is a step of advancing 230 the first and second process gas flows along separate preferably substantially rectilinear paths (preferably parallel to each other) in order to reduce or remove flow non-uniformities in the first and second process gas flows. Preferably, each rectilinear path has a length comprised between for example about 2.5 and about 6.0 times the collector inlet diameter. Preferably, these rectilinear paths do not extend further than the desired length in order to reduce the amount of space.

After step 230, there is a step 240 of admitting the first and second process gas flows in a plenum chamber, such as plenum chamber 115.

After step 240, there is a step 250 of keeping the two flows process gas flows separated inside the plenum chamber 115 in particular by means of septa, such as septa 140*a* and 140*b*.

After step 250, there is a step of merging 260 the first and second process gas flows to create a desired suction process gas flow which is "optimized" in view for example of the impeller that will compress it. In compressor 100, this occurs at the outlet of plenum chamber, in particular somehow before the outlet and somehow after the outlet for example in a connecting channel, such as channel 125.

After step 260, there is a final step 270 of feeding the "optimized" process gas flow to an impeller of a centrifugal compressor, such as 130.

The invention claimed is:

1. A centrifugal compressor, comprising:

a housing having a first inlet and a second inlet, the housing forming a plenum chamber with an outlet spaced apart from the first inlet and the second inlet a shaft disposed in the plenum chamber;

an impeller coupled to the shaft and located inside the housing downstream of the plenum chamber, the impeller arranged to increase gas pressure as process gas flows past the impeller; and a first septum and a second septum disposed in the plenum chamber, the first septum and the second septum having a body extending from a first end coupled to the housing into the plenum chamber towards the shaft, the body terminating at a second end with a first portion secured to the housing and a second portion disposed in the outlet.

2. The centrifugal compressor of claim 1, wherein the first inlet and the second inlet have substantially equal cross-sections.

3. The centrifugal compressor of claim 1, wherein the shaft rotates on a rotation axis, wherein the centrifugal compressor has a meridional plane arranged vertically with respect to a working configuration for said centrifugal compressor and containing the rotation axis, and wherein the first inlet and the second inlet are symmetrically arranged on either side of the meridional plane.

4. The centrifugal compressor of claim 1, wherein the plenum chamber has a cylindrical shape, a frustoconical shape, or an annular shape, and wherein the first inlet and the second inlet are located on a lateral surface of the plenum chamber.

5. The centrifugal compressor of claim 2, wherein the first septum and the second septum are arranged on the meridional plane.

6. The centrifugal compressor of claim 1, wherein the first septum is close to the first inlet and the second inlet and the second septum is remote from the first inlet and the second inlet.

7. The centrifugal compressor of claim 1, wherein the housing has a radially outer wall and a radially inner wall facing the radially outer wall and proximate the shaft, wherein the radially outer wall and the radially inner wall define the plenum chamber, and wherein the outlet of the plenum faces the radially outer wall and the first inlet and the second inlet and is adjacent the radially inner wall.

8. The centrifugal compressor of claim 1, wherein the housing forms a shaped connecting channel that terminates on one end at the outlet to the plenum chamber.

9. The centrifugal compressor of claim 1, further comprising:

two collectors protruding from the housing, each collector comprising:

a collector inlet arranged to be fluidly coupled to a suction duct, and a collector outlet fluidly coupled to the inlet, wherein the two collectors are configured to reduce or eliminate non-uniformity in a flow of process gas from the collector inlet to the collector outlet.

10. The centrifugal compressor of claim 9, wherein each collector defines a divergent duct that diverges from the collector inlet to the collector outlet.

11. The centrifugal compressor of claim 9, wherein a distance between the collector inlet and the collector outlet is between about 1 and about 3 times a diameter of the collector inlet.

12. The centrifugal compressor of claim 9, wherein the two collectors comprise end portions adjacent to the collector outlet, wherein the end portions extend longitudinally along respective straight lines, and wherein the straight lines form an angle an angle in a range of from about 15° to about 30°.

13. A compressor system, comprising:

a centrifugal compressor of claim 1.

14. The centrifugal compressor of claim 1, wherein the first end of first septum is between the first inlet and the second inlet.

15. The centrifugal compressor of claim 1, wherein the first septum and the second septum reside on opposite sides of the plenum chamber.

16. The centrifugal compressor of claim 1, wherein the first end of the first septum couples to a first location of the housing and the first end of the second septum couples to a second location of the housing that is different from the first location.

17. The centrifugal compressor of claim 9, wherein an area ratio between the collector inlet cross-section and the collector outlet cross-section is between about 1.0 and about 1.3.

18. The centrifugal compressor of claim 9, wherein the two collectors comprise end portions adjacent to the collector outlet, wherein the end portions extend longitudinally along respective straight lines, and wherein the straight lines form an angle an angle in a range of from about 15° to about 30°, and wherein the straight lines intersect at a point of intersection preferably remote from an axis of the plenum chamber.

* * * * *